US006827227B2

(12) United States Patent
Fontana

(10) Patent No.: US 6,827,227 B2
(45) Date of Patent: Dec. 7, 2004

(54) RECLOSABLE CONTAINER PARTICULARLY FOR FLUID PRODUCTS

(75) Inventor: Antonio Fontana, Carpi (IT)

(73) Assignee: Lameplast S.p.A, Rovereto di Novi (IT)

( * ) Notice: Subject to any disclaimer, the term of this patent is extended or adjusted under 35 U.S.C. 154(b) by 0 days.

(21) Appl. No.: 10/297,443

(22) PCT Filed: Jun. 11, 2001

(86) PCT No.: PCT/EP01/06594

§ 371 (c)(1),
(2), (4) Date: Dec. 6, 2002

(87) PCT Pub. No.: WO01/96186

PCT Pub. Date: Dec. 20, 2001

(65) Prior Publication Data

US 2003/0155356 A1 Aug. 21, 2003

(30) Foreign Application Priority Data

Jun. 15, 2000 (IT) ..... MO2000A0130

(51) Int. Cl.[7] ..... B65D 1/02
(52) U.S. Cl. ..... 215/48; 215/47; 215/50; 215/250
(58) Field of Search ..... 215/47, 48, 50, 215/250, 252, 253, 330, 321, 45

(56) References Cited

U.S. PATENT DOCUMENTS 621,161 A * 3/1899 Shaw
3,994,412 A 11/1976 Difiglio
4,378,891 A * 4/1983 Fowles et al. ..... 215/48
4,655,355 A * 4/1987 Turoff et al. ..... 215/48
5,590,798 A * 1/1997 O'Connell ..... 215/48
5,908,124 A * 6/1999 Klauke et al. ..... 215/48
6,173,852 B1 * 1/2001 Browne ..... 215/247

FOREIGN PATENT DOCUMENTS

FR 1471203 A * 5/1967
FR 1 471 203 5/1967
GB 1 446 300 8/1976
GB 1446300 A * 8/1976 ..... B65D/4/60
WO 97 01493 1/1997
WO 97 49611 12/1997

* cited by examiner

*Primary Examiner*—Jacob K. Aokun
*Assistant Examiner*—Bena B. Miller
(74) *Attorney, Agent, or Firm*—Guido Modiano; Albert Josif; Daniel O'Byrne

(57) ABSTRACT

A reclosable container, particularly for fluid products, comprising a hollow body for containing the product which has, in an upward region, a neck provided with a dispensing opening and closure means constituted by a grip portion which supports a closure for the opening, the closing means being rigidly coupled to the grip portion, and by at least one annular band which is substantially coaxial to the closure and is fixed to the grip portion along preset-fracture regions formed on its outer surface and is fitted so as to adhere to the neck.

10 Claims, 2 Drawing Sheets

RECLOSABLE CONTAINER PARTICULARLY FOR FLUID PRODUCTS

TECHNICAL FIELD

The present invention relates to a reclosable container, particularly for fluid products such as, for example, pharmaceutical, medical and cosmetic products, such container being usually produced by injection-molding polymeric material.

BACKGROUND ART

Reclosable containers made of polymeric material comprising two separate portions which are produced separately and thereafter assembled, are already known.

A first portion is constituted by a hollow body for containing a preset dose of product, such body being provided with a mouth for dispensing the product.

The second portion is constituted by closure means which can be coupled to such body in order to close the dispensing mouth.

These conventional containers are not devoid of drawbacks, including the fact that they do not allow users to detect readily and immediately any attempt by third parties to tamper with such containers and/or to open them.

In other words, attempts to tamper with and/or open them usually leave in said containers no traces that can be readily detected by users; accordingly, the users might use a product that has been altered, for example by contamination with external contaminants, so as to modify its composition or integrity, without being aware of these modifications.

Containers which are formed monolithically, i.e., in which the product containment body is formed together with the closure means as a single unit, without discontinuities, are also known.

The closure means are connected to the body by way of deformable and breakable elements which act as safety seals; any deformation and/or breakage of such elements in an indication of tampering.

However, manufacturing these containers monolithically requires the use of very complex molds and entails high production costs.

DISCLOSURE OF THE INVENTION

The aim of the present invention is to eliminate the above mentioned drawbacks of conventional containers, by providing a reclosable container, particularly for fluid products, which allows to make evident, in a straightforward manner which can be clearly perceived by users, any attempt to tamper with said container and open it.

Another object of the present container is to ensure the integrity of the product contained therein, fully to the advantage of greater safety for users, particularly in the case of pharmaceutical, medical and cosmetic products.

Finally, another object of the present invention is to simplify the structure of the molds required to form the container.

Within this aim, another object of the present invention is to provide a structure which is simple, relatively easy to provide in practice, safe in use, effective in operation, and relatively low in cost.

This aim and these and other objects which will become better apparent hereinafter are achieved by the present reclosable container, particularly for fluid products, comprising a hollow body, for containing the product, which has, in an upward region, a neck provided with a dispensing opening and closure means constituted by a grip portion which supports means for closing said opening, said closure means being rigidly coupled to said grip portion, characterized in that said closure means comprise at least one annular band which is substantially coaxial to said closure means and is fixed to said grip portion along preset-fracture regions formed on its outer surface and is fitted so as to adhere to said neck.

BRIEF DESCRIPTION OF THE DRAWINGS

Further characteristics and advantages of the present invention will become better apparent from the detailed description of a preferred but not exclusive embodiment of a reclosable container, particularly for fluid products, illustrated only by way of non-limitative example in the accompanying drawings, wherein.

WAYS OF CARRYING OUT THE INVENTION

Figure 1:
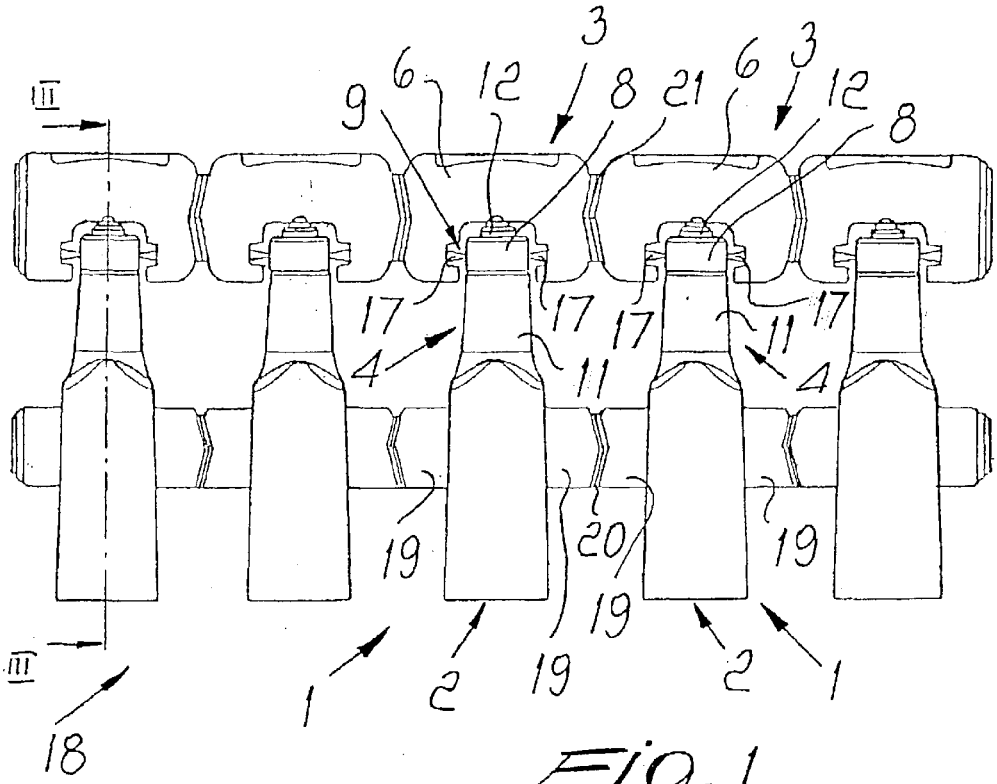
FIG. 1 is a front view of a plurality of containers according to the invention.
Figure 2:
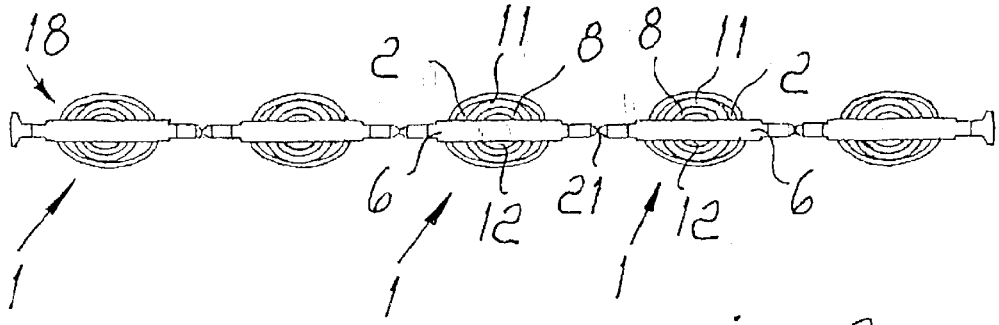
FIG. 2 is a top view of the containers of FIG. 1.
Figure 5:
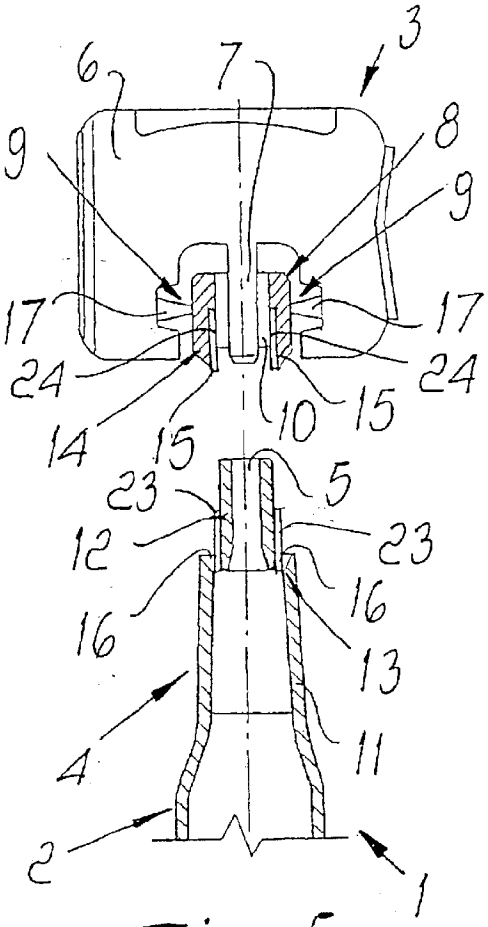
FIG. 5 is a partially sectional exploded view of the detail of FIG. 4.
Figure 4:
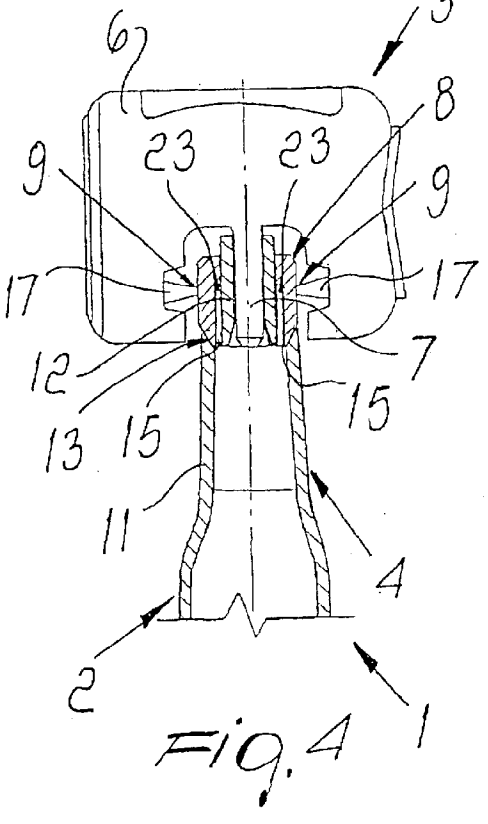
FIG. 4 is a partially sectional view in enlarged scale of a detail of a container according to the invention.
Figure 3:
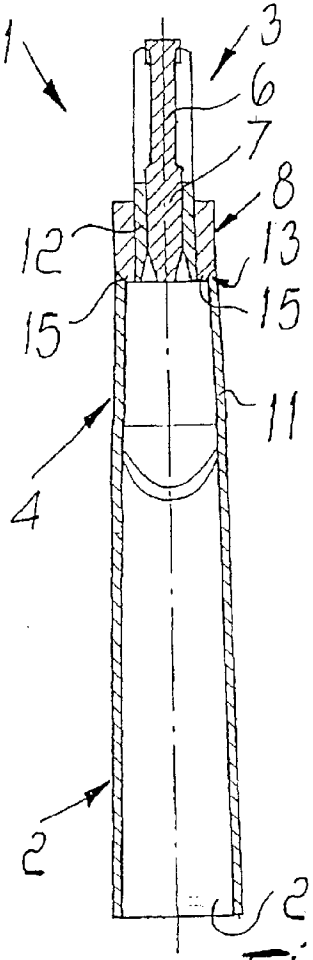
FIG. 3 is a sectional view, taken along the line III—III, of the containers of FIG. 1.

With reference to the figures, 1 generally designates a reclosable container, particularly for fluid products such as, for example pharmaceutical, medical and cosmetic products.

The container 1 is usually made of polymeric material, such as polyethylene or polypropylene, with formation methods such as injection-molding.

The container 1 is constituted by two portions: a hollow product containment body 2 and closure means 3 which are assembled one another after they have been formed.

The body 2 is substantially longitudinally elongated and has, in an upward region, a neck 4 in which a product dispensing opening 5 is formed.

The closure means 3 are constituted by a grip portion 6 which is arranged substantially transversely and supports, rigidly coupled thereto, means for closing the opening 5 such as, for example, a cylindrical plug 7 which can be inserted hermetically in said opening 5.

The closure means 3 further comprise an annular band 8 which is substantially coaxial to the plug 7 and is fixed to the grip portion 6 along preset-fracture regions 9 formed on its outer lateral surface; such band 8 is fitted so as to adhere to the neck 4.

A gap 10 of preset dimension is formed between the band 8 and the plug 7, and the neck 4 can be inserted therein.

Advantageously, the neck 4 is constituted by two substantially cylindrical portions having different diameters: a lower portion 11 and an upper portion 12 which are mutually aligned so that they are substantially coaxial.

The lower portion 11 has a larger diameter than the upper portion 12, at the base of which an annular seat 13 is provided, being suitable to accommodate the lower end 14 of the band 8.

The upper portion 12, in which the opening 5 is provided, can be inserted in the gap 10 defined between the band 8 and the plug 7.

Conveniently, the container 1 comprises means for the interlocking coupling of the band 8 with the neck 4, such means being constituted by a plurality of protrusions 15 which are formed at the lower end 14 of the band 8 and can be inserted in corresponding complementarily shaped recesses 16 formed in the seat 13.

Alternatively, the protrusions can be formed proximate to the seat 13 and can be inserted in corresponding counter-shaped recesses formed in the lower end 14 of the band 8.

It is further possible to make the band 8 adhere to the neck 4 and fix it by gluing or sealing; the sealing can be any of a thermal, ultrasound or high-frequency kind.

The preset-fracture regions 9 are constituted by two breakable bridges 17 which are substantially opposite one another and connect the grip portion 6 to the outer lateral surface of the band 8.

The regions 9 can also be constituted by wings, straps or simple fracture lines formed between the grip portion 6 and the outer lateral surface of the band 8.

Advantageously, the containers 1 are produced in sets so as to constitute packs 18.

The bodies 2 of two successive containers 1 of the pack 18 are provided with respective connecting wings 19 which are joined to each other along preset-fracture lines 20, while the grip portions 6 of the respective closure means 3 are connected one another along preset-fracture lines 21. It is thus possible to separate from the pack 18 a single container 1 when it is to be used.

Finally, the body 2 is provided, in a downward region, with a mouth 22 through which the product is introduced in the container 1; the mouth being closeable by sealing.

Conveniently, two diametrically opposite longitudinal ridges 23 are provided on the upper portion 12 of the neck 4, protrude therefrom and enter two corresponding grooves 24 formed in the inner wall of the band 8.

The coupling between the ridges 23 and the respective grooves or seats 24 further prevents the band 7 from rotating and disengaging from the neck 4 when the container 1 is opened.

The closure means 3 and the body 2, formed separately in two parts, are assembled one another by inserting the plug 7 in the opening 5 and by then inserting the upper portion 12 of the neck 4 in the gap 10 until the lower end 14 of the band 8 abuts against the seat 13.

In this configuration, the band 8 surrounds externally the neck 4, whose upper portion 12 protrudes upwardly from the band 8.

The band 8 is interlocked and/or glued and/or sealed to the neck 4, for example along the line where its lower end 14 connects to the lower portion 11 of said neck 4; accordingly, it is fixed so as to adhere to said neck 4, and it is fixed to the grip portion 6 by means of the breakable bridges 17.

Advantageously, if the band 8 is sealed to the neck 4, for example by means of the ultrasonic method, the ridges 23 are larger than the grooves 24; in this manner, once the ridges have been forced into the grooves, the excess material melts locally, facilitating the sealing process and stably fixing the band 8 on the neck 4.

The product is introduced in the body 2 through the mouth 22, which is subsequently closed by sealing.

Any opening of the container 1 and/or attempt to tamper with it in order to modify the mutual configuration of the closure means 3 and of the body 2, once assembled and packaged, such as for example the application of a torsional stress and/or a traction of the closure means with respect to the body, causes accordingly the breakage of the bridges 17 and the separation of the band 8 from the grip portion 6.

The band 8, which continues to adhere to the neck 4, clearly indicates that the container 1 has been opened or tampered with.

In practice it has been observed that the described invention achieves the intended aim and objects.

The invention thus conceived is susceptible of numerous modifications and variations, all of which are within the scope of the appended claims.

All the details may furthermore be replaced with other technically equivalent elements.

In practice, the materials used, as well as the shapes and the dimensions, may be any according to requirements without thereby abandoning the scope of the protection of the appended claims.

The disclosures in Italian Patent Application No. MO2000A000130 from which this application claims priority are incorporated herein by reference.

What is claimed is:

1. A reclosable container, particularly for fluid products, of the type that comprises a hollow body for containing the product which has, in an upward region, a neck provided with a dispensing opening and closure means constituted by a grip portion which supports closing means for closing said opening, said closing means being rigidly coupled to said grip portion, wherein said closure means comprise at least on annular band which is substantially coaxial to said closing means and is fixed to said grip portion along preset-fracture regions formed on its outer surface and is fitted so as to adhere to said neck said neck being constituted by two substantially cylindrical portions, an upper one and a lower one, which are mutually aligned so as to be substantially coaxial, said lower portion having a larger diameter than said upper portion so as to form an annular seat which is suitable to accommodate the lower end of said band and said upper portion being provided with said dispensing opening and being insertable in said annular band.

2. The container according to claim 1, further comprising at least one longitudinal ridge which is formed on said neck proximate to said dispensing opening and can be inserted in a corresponding groove forming a seat in said band, the coupling between said at least one ridge and said seat being suitable to prevent the rotation of said band with respect to said neck.

3. The container according to claim 2, further comprising two said longitudinal ridges which are formed, so as to protrude and be mutually diametrically opposite, on the upper portion of the neck and can be inserted in two said corresponding grooves which are formed in said band so as to be diametrically mutually opposite.

4. The container according to claim 1, further comprising means for the interlocking coupling of said band with said neck.

5. The container according to claim 4, wherein said interlocking coupling means is constituted by a plurality of protrusions which are formed at said lower end of the band and can be inserted in corresponding counter-shaped recesses formed in said annular seat.

6. The container according to claim 5, wherein said band is sealed to said neck.

7. The container according to claim 5, wherein said band is glued to said neck.

8. The container according to claim 4, wherein said interlocking coupling means are constituted by a plurality of protrusions, formed at said annular seat, which can be inserted in corresponding complementarily shaped recesses formed in said lower end of the band.

9. The container according to claim 1, wherein said preset-fracture regions are constituted by at least two breakable bridges which are arranged substantially mutually opposite and connect said grip portion to the outer surface of said annular band.

10. The container according claim 1, wherein said closure means are constituted by a substantially cylindrical plug which can be inserted hermetically in said opening.

* * * * *